US008308346B2

(12) United States Patent
Conus et al.

(10) Patent No.: US 8,308,346 B2
(45) Date of Patent: Nov. 13, 2012

(54) LEVER ESCAPEMENT FOR A TIMEPIECE

(75) Inventors: Thierry Conus, Lengnau (CH); Andres Cabezas Jurin, Yverdon (CH)

(73) Assignee: Omega SA, Biel/Bienne (CH)

( * ) Notice: Subject to any disclaimer, the term of this patent is extended or adjusted under 35 U.S.C. 154(b) by 326 days.

(21) Appl. No.: 12/602,011

(22) PCT Filed: May 15, 2008

(86) PCT No.: PCT/EP2008/055984
§ 371 (c)(1),
(2), (4) Date: Nov. 25, 2009

(87) PCT Pub. No.: WO2008/145539
PCT Pub. Date: Dec. 4, 2008

(65) Prior Publication Data

US 2010/0182879 A1 Jul. 22, 2010

(30) Foreign Application Priority Data

May 30, 2007 (EP) ..... 07109193

(51) Int. Cl.
*G04B 15/00* (2006.01)

(52) U.S. Cl. ..... 368/131; 368/124

(58) Field of Classification Search ..... 368/124, 368/127, 128, 129, 130, 131, 132
See application file for complete search history.

(56) References Cited

FOREIGN PATENT DOCUMENTS

| | | |
|---|---|---|
| EP | 0 018 796 A2 | 11/1980 |
| EP | 1 045 297 A1 | 10/2000 |

OTHER PUBLICATIONS

Daniels, G., "La Montre: Principes et Methodes de Fabrication", 1993, Editions Scriptar SA, Lausanne, XP002468957.

*Primary Examiner* — Renee Luebke
*Assistant Examiner* — Jason Collins
(74) *Attorney, Agent, or Firm* — Sughrue Mion, PLLC

(57) ABSTRACT

The escapement comprises an escape wheel assembly (1), a balance roller (3) carrying an impulse pin (4) and a first impulse pallet (5). It further comprises a lever (8) provided with a second impulse pallet (11) and with first and second locking pallets (12, 13). The wheel assembly (1) comprises an escape wheel with teeth (6) that mesh directly with the teeth (20) of the last wheel of a gear train (2), the teeth (6) of the wheel (1) engaging with the impulse and locking pallets.

1 Claim, 4 Drawing Sheets

LEVER ESCAPEMENT FOR A TIMEPIECE

CROSS REFERENCE TO RELATED APPLICATION

Figure 1:
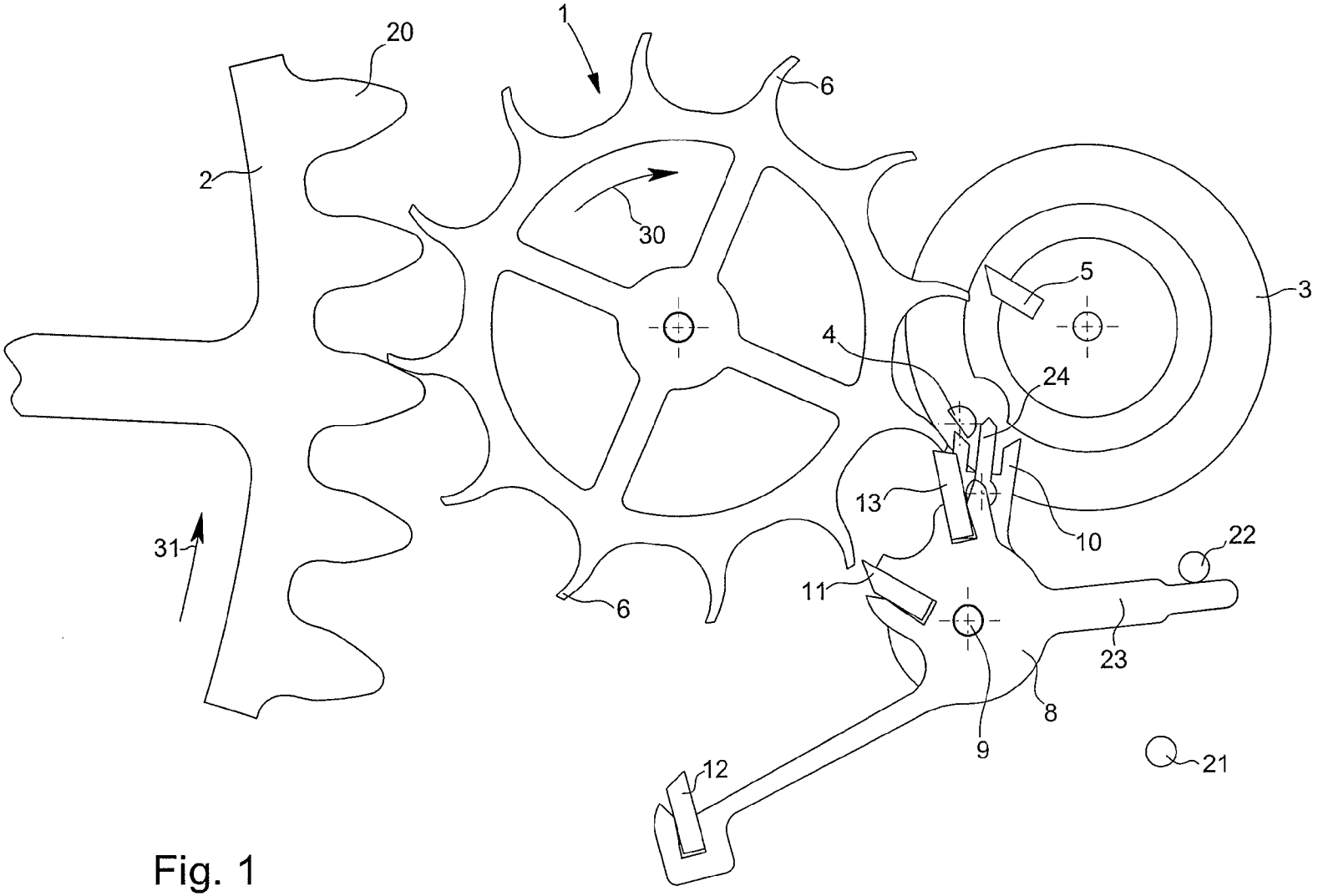

This is a National Phase Application in the United States of International Patent Application PCT/EP2008/055984 filed May 15, 2008, which claims priority on European Patent Application No. 07109193.8 of May 30, 2007. The entire disclosures of the above patent applications are hereby incorporated by reference.

The invention relates to a lever escapement for a timepiece that includes an escape wheel set, driven by a gear train, a balance roller carrying an impulse pin and fitted with a first impulse pallet stone arranged for cooperating with the teeth of the wheel set and a lever articulated on a pivot and fitted with a fork that cooperates with the impulse pin, wherein the lever is fitted with a second impulse pallet stone arranged for cooperating with the teeth carried by the wheel set and first and second locking pallet stones arranged for cooperating with the teeth carried by the wheel set.

This type of escapement is known and disclosed in Patent No. EP-B-18796, which bears the name of George Daniels as inventor. This escapement has several embodiments, since the escape wheel set can be formed by a single wheel or two coaxial wheels secured to each other. However, in this document, the wheel set is driven by the gear train via an escape pinion, which is mounted in a conventional manner on the arbour of said wheel set, and not directly by one of the wheels of the wheel set.

In order to simplify the proposed system and especially to save space heightwise, George Daniels devised a design which he named the extra-flat coaxial escapement and which he disclosed in pages 249 to 253 of his work entitled "La Montre: principes et méthodes de fabrication", Editions Scriptar S. A. La Conversion, Lausanne 1993. This design includes a wheel set formed of two coaxial escape wheels secured to each other. The first wheel cooperates with two locking pallet stones and an impulse pallet stone, which is arranged on the balance roller and gives direct impulses thereto. The second wheel cooperates with an impulse pallet stone arranged on the lever, which gives indirect impulses to the roller. This second wheel is directly driven via its own teeth by the last wheel set forming the timepiece gear train. Thus, there is no use here of the conventional escape pinion mentioned above, which helps to reduce the thickness of the escape system. Thus, one escape wheel set is given the dual function of receiving motion from the gear train and contributing to at least one of the escapement functions. The George Daniels system only provides an indirect impulse function and it will be clear that any other function attributed to this wheel set, apart from the aforementioned function, constitutes a novelty for this type of escapement.

It is an object of the present invention to further reduce the size of the escapement heightwise. This object is achieved in accordance with the annexed claim 1, by providing a lever escapement for a timepiece that has only a single wheel driven directly by the gear train.

Other features and advantages of the present invention will appear upon reading the following detailed description, given solely by way of non-limiting example, with reference to the annexed drawings, in which:

FIG. 1 is a plan view of a particular embodiment of the present invention, and FIGS. 2 to 13 are plan views explaining the operating phases peculiar to escapements of the type mentioned in the preamble of this description and which thus also apply to the escapement of the present invention. The operating phases shown cover one complete oscillation of the balance roller.

FIG. 1 is a plan view of the escape mechanism according to a first embodiment of the invention. This escapement includes an escape wheel set 1 driven by a gear train 2 and a balance roller 3 (the balance is not shown) carrying an impulse pin 4. When it is moving, escape wheel set 1 rotates in the direction of arrow 30, driven by gear train 2, which rotates in the direction of arrow 31.

Roller 3 is fitted with a first impulse pallet stone 5, arranged for cooperating with the teeth 6 of wheel set 1. The escapement also includes a lever 8, articulated on a pivot 9 and fitted with a fork 10 that cooperates with impulse pin 4 of roller 3. This lever is fitted with a second impulse pallet stone 11, arranged for cooperating with the teeth 6 of wheel set 1, and first and second locking pallet stones 12 and 13, arranged for cooperating with the teeth 6 of wheel set 1. The fork 10 is fitted with a guard pin 24, which prevents lever 8 from accidentally tipping. The impulse pin 4 concerned here may be a sapphire or steel part added to roller 3, as is the case in escapements of the prior art. The present invention is not, however, limited to this type of embodiment, since the impulse pin may be integral with the roller on which it is mounted, or even form part of an element that has a particular shape and is secured to the roller. The same is true of the various pallet stones 5, 10, 11 and 13 involved here. These may also be small sapphire parts, with the last three pallet stones set in the arms of lever 8 and first pallet stone 5 set in roller 3. Here too, the invention is not limited to this type of embodiment, since the pallet stones may be integral with the lever or roller respectively.

As FIG. 1 clearly shows, the present invention is characterized in that wheel set 1 has a single escape wheel 1 and its teeth 6 mesh directly with gear train 2 and more specifically with the gear train teeth 20. This gear train or going train is in fact all of wheels and pinions which transmit the drive force from the barrel to escape wheel 1. The gear train 2 illustrated here is the last wheel of the series often called the fourth wheel or second wheel. In a conventional movement, this fourth wheel meshes directly with the escape pinion that does not exist in the present invention.

An escapement of the type matching the preamble of this description and comprising only one escape wheel is illustrated at page 248 of the aforementioned work by George Daniels. FIG. 1 of the present invention shows that it is possible to replace the escape wheel of the aforecited document by the escape wheel of the invention, in a particular configuration, such that it can be directly driven by gear train 2 at the same time that it fulfils all the escape functions, i.e. it cooperates with the two impulse pallet stones 5 and 11 and the two locking pallet stones 12 and 13. It will be clear that the design proposed takes an extremely small amount of space heightwise and it is economical in terms of the number of parts involved.

The operation of the escapement according to the invention will now be explained with reference to FIGS. 2 to 13. The lever escapement for a timepiece illustrated in these Figures includes two escape wheels 14 and 15. However, apart from this difference, the operating principle of this escapement is the same as that of the present invention. One complete oscillation of roller 3 is illustrated in FIGS. 2 to 13 and the various operating phases will be analysed below.

Figure 2:
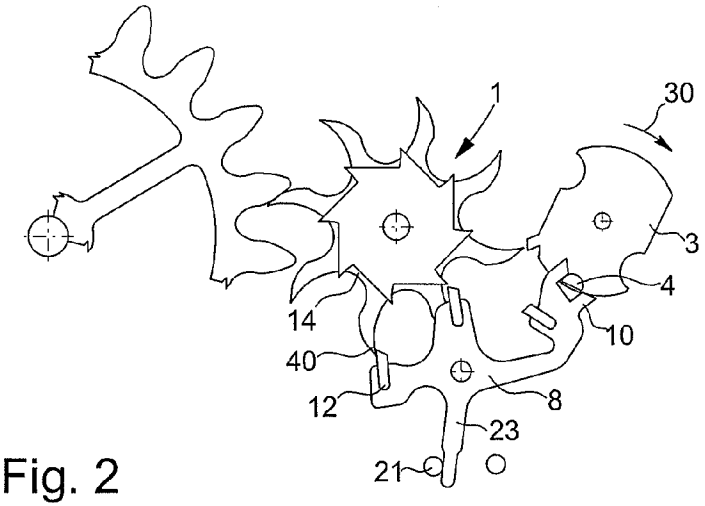

In FIG. 2, roller 3 is rotating in the direction of arrow 30. The escape wheel set 1 is locked, retained by the locking pallet stone 12, which is abutting on tooth 40 of first wheel 14. The tail 23 of lever 8 is abutting on banking pin 21. Impulse pin 4 of roller 3 has penetrated the empty space in fork 10 and entered into contact with one tooth of the fork. This is the start of the unlocking phase of locking pallet stone 12.

Figure 3:
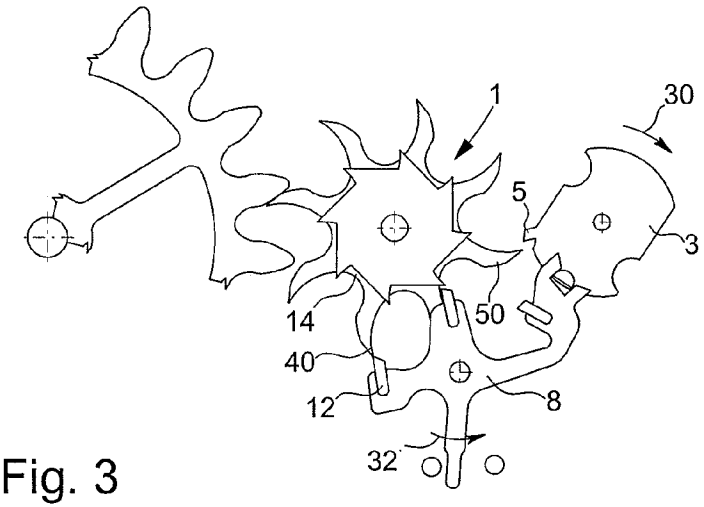

As FIG. 3 shows, roller 3 continues to rotate in the direction of arrow 30 causing lever 8 to pivot in the direction of arrow 32. This pivoting brings locking pallet stone 12 to the end of tooth 40 of wheel 14 causing it to exit the hold of that tooth. This is the release phase of escape wheel set 1. It will be noted also that, in rotating, roller 3 has led its first impulse pallet stone 5 to intersect the trajectory of tooth 50 of first wheel 14 forming escape wheel set 1.

Figure 4:
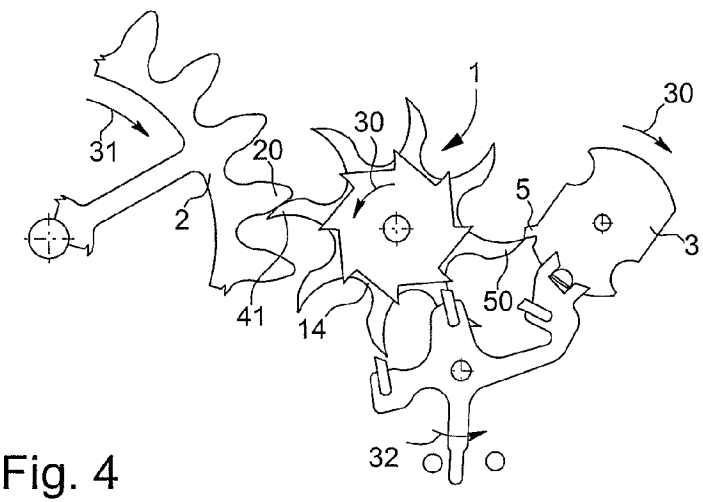

In FIG. 4, escape wheel set 1 is released and rotating in the direction of arrow 30, actuated by gear train 2 whose last wheel is rotating in the direction of arrow 31. The teeth of first escape wheel 14 mesh directly with the teeth of the last wheel of gear train 2, in this case, tooth 20 is driving tooth 41 of wheel 14. Tooth 50 of wheel 14 has caught up with impulse pallet stone 5 secured to roller 3, then entered into contact therewith. This is a start of impulse phase for relaunching roller 3.

Figure 5:
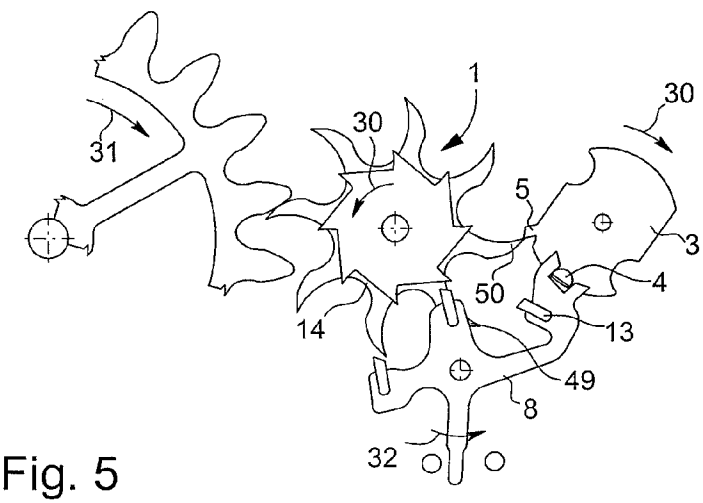

FIG. 5 shows the end of impulse phase. Escape wheel set 1, rotating in the direction of arrow 30, has brought tooth 50 of wheel 14 into the position shown in the Figure, i.e. on the point of letting go of impulse pallet stone 5. It will be observed that, in rotating, roller 3 has continued to drive lever 8 in the direction of arrow 32, via impulse pin 4, which consequently causes second locking pallet stone 13 to intersect the trajectory of tooth 49 of first wheel 14, thus preparing for the first lock.

Figure 6:
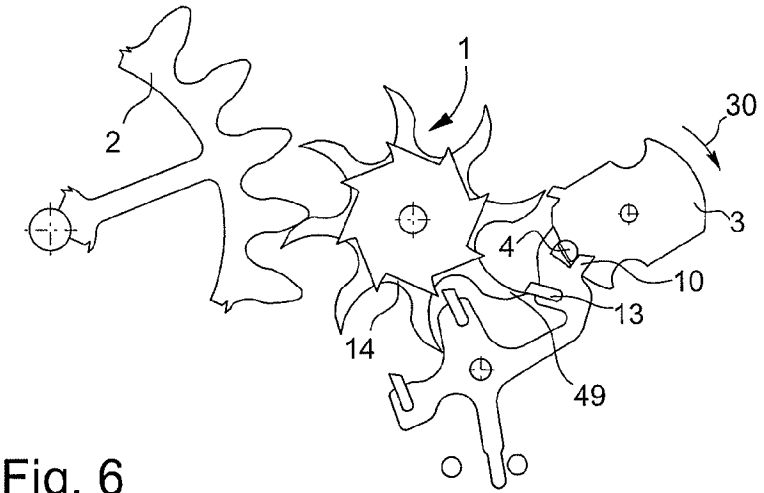

FIG. 6 shows the lock of tooth 49 of first wheel 14 on locking pallet stone 13. Roller 3 continues its rotation in the direction of arrow 30 and impulse pin 4 is on the point of exiting fork 10.

Figure 7:
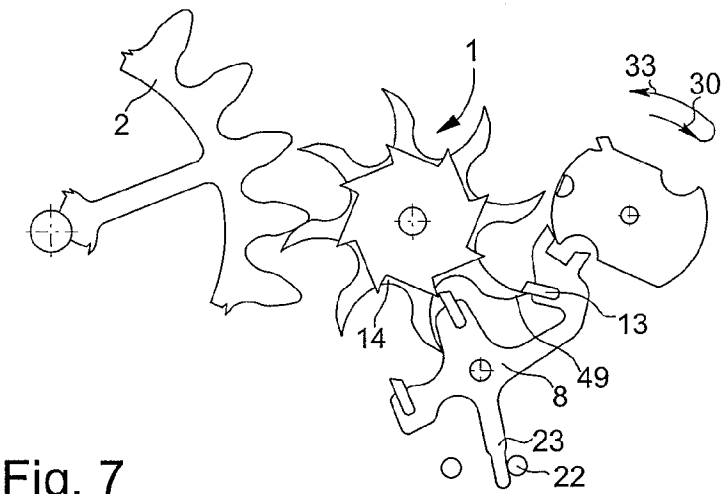

FIG. 7 shows the escapement of the invention in a state of total lock. Via the effect of draw caused by the torque exerted on escape wheel 1, locking pallet stone 13 has moved deeper onto tooth 49 of first wheel 14 and the tail 23 of lever 8 is abutting on banking pin 22. From this moment, roller 3 describes its supplementary arc along the direction of arrow 30, and then reverses its direction and turns back along the direction of arrow 33. This phase marks the end of the first vibration of the oscillation being examined.

Figure 8:
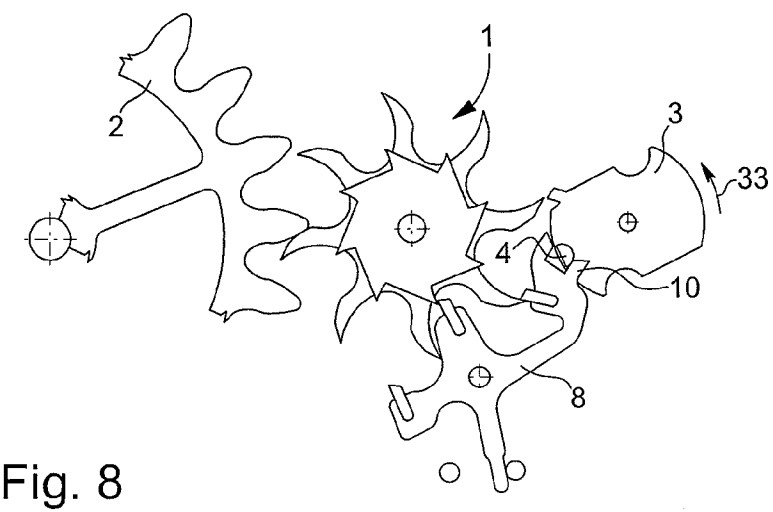

FIG. 8 shows a lever 8 in the same situation as that analysed above. Here, however, roller 3, returning in the direction of arrow 33, causes impulse pin 4 to come into contact with fork 10 of lever 8. This is a start of unlock phase of escape wheel set 1.

Figure 9:
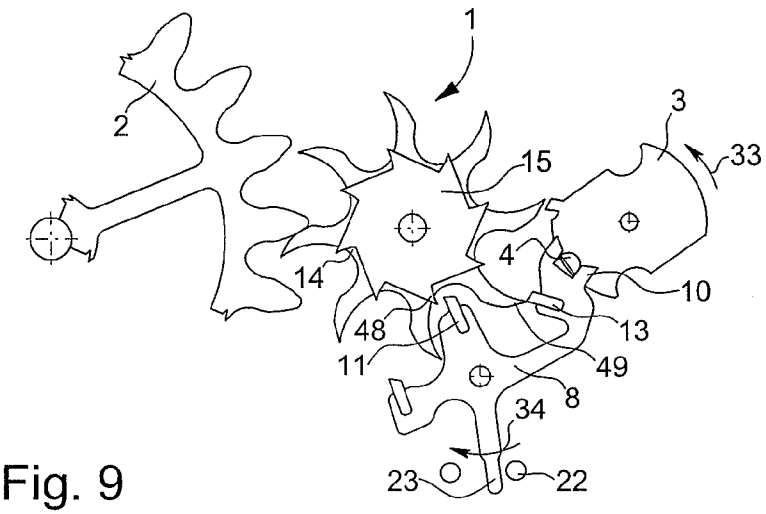

As is clear in FIG. 9, roller 3 has continued its travel in the direction of arrow 33 and, via impulse pin 4 and fork 10, has driven lever 8 in the direction of arrow 34. Tail 23 of lever 8 has become detached from banking pin 22 and locking pallet stone 13 has been released from the hold of tooth 49 of first wheel 14. This is a release phase of wheel set 1. Here too, it will be noted that in rotating, roller 3 has caused the second impulse pallet stone 11, carried by lever 8, to intersect the trajectory of tooth 48 of the second escape wheel 15 forming escape wheel set 1, thus preparing for the next impulse.

Figure 10:
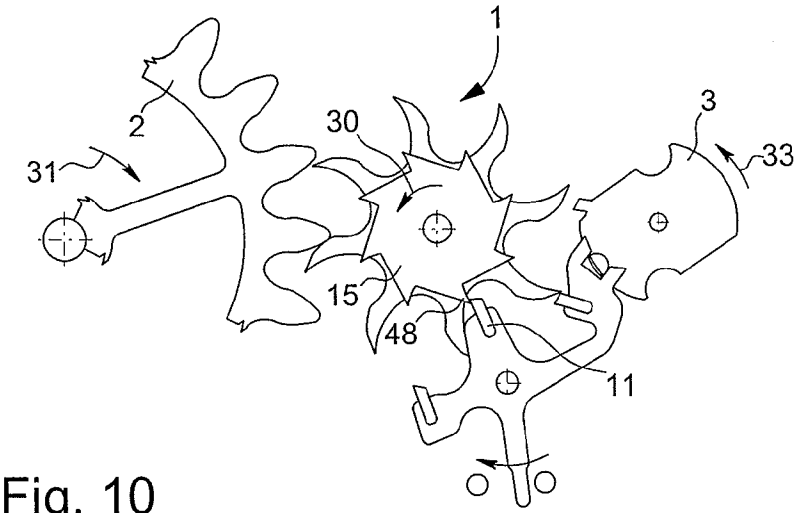

In FIG. 10 escape wheel set 1 has been released and is rotating in the direction of arrow 30, actuated by gear train 2, as was explained above. Tooth 48 of second wheel 15 has caught up with impulse pallet stone 11 then entered into contact therewith. This is again a start of impulse phase for relaunching roller 3.

Figure 11:
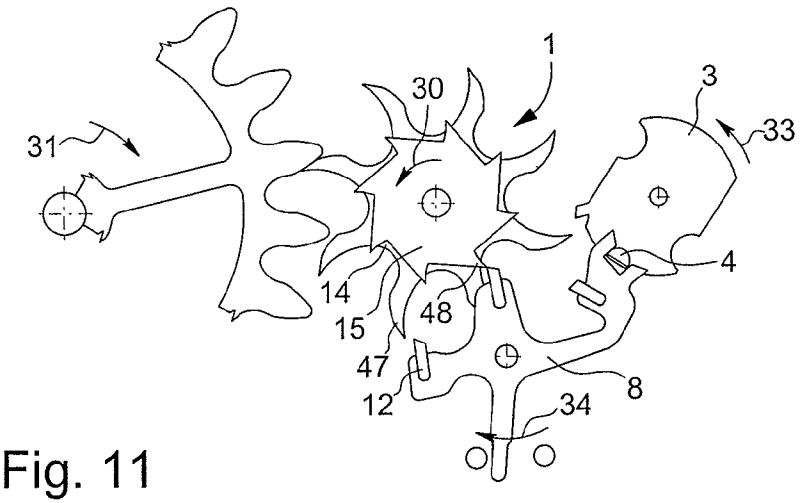

The end of impulse phase is shown in FIG. 11. Escape wheel set 1, rotating in the direction of arrow 30, has brought tooth 48 of second wheel 15 into the position illustrated in the Figure, namely on the point of letting go. It will be observed again that, in rotating in the direction of arrow 33, roller 3 has continued to drive lever 8, via impulse pin 4, in the direction of arrow 34, which consequently causes first locking pallet stone 12 to intersect the trajectory of tooth 47 of first escape wheel 14, thus preparing for the next lock.

Figure 12:
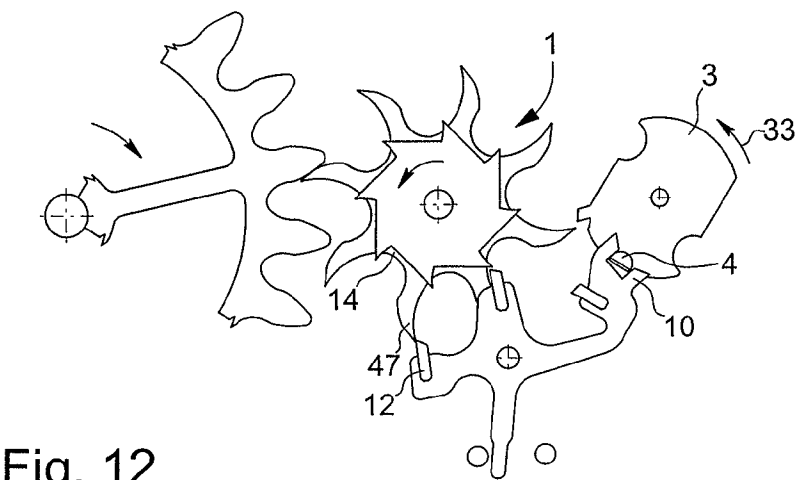

FIG. 12 shows the hold of tooth 47 of the first wheel 14 on locking pallet stone 12. Roller 3 continues its rotation in the direction of arrow 33 and impulse pin 4 is on the point of leaving fork 10.

Figure 13:
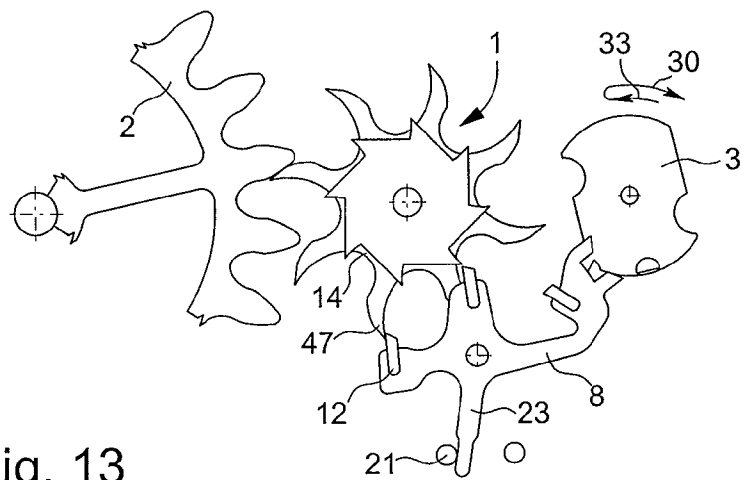

FIG. 13 shows the escapement of the invention in a state of total lock. Via the effect of draw, locking pallet stone 12 has moved more deeply onto tooth 47 of first wheel 14 and tail 23 of lever 8 is abutting on banking pin 21. From this moment, roller 3 describes its supplementary arc along the direction of arrow 33 then reverses its direction and turns back along the direction of arrow 30. This phase marks the end of the second vibration of the oscillation under examination. From this moment a new cycle begins and we return to the starting situation, i.e. that shown in FIG. 2.

The invention claimed is:

1. Lever escapement for a timepiece including a single escape wheel driven by a gear train made up of a series of wheels and pinions for transmitting a drive force to the escape wheel, a balance roller carrying an impulse pin and fitted with a first impulse pallet arranged for cooperating with the teeth of the escape wheel and a lever articulated on a pivot and provided with a fork that cooperates with the impulse pin, wherein said lever is fitted with a second impulse pallet arranged for cooperating with the teeth of the escape wheel and first and second locking pallets arranged for cooperating with the teeth of the escape wheel, wherein the escape wheel directly meshes with a last wheel of the series of wheels and pinions forming said gear train.

* * * * *